US006875041B1

(12) United States Patent
Chang et al.

(10) Patent No.: US 6,875,041 B1
(45) Date of Patent: Apr. 5, 2005

(54) LATCH FOR ELECTRICAL DEVICE COMBINED WITH DATA CARD EJECTOR

(75) Inventors: Yu-Chuan Chang, Taipei Hsien (TW); Chin-Kai Sun, Pan-Chiao (TW); Leo Lai, Tao-Yuan Hsien (TW)

(73) Assignee: BenQ Corporation, Tao-Yuan Hsien (TW)

( * ) Notice: Subject to any disclaimer, the term of this patent is extended or adjusted under 35 U.S.C. 154(b) by 0 days.

(21) Appl. No.: 10/605,194

(22) Filed: Sep. 15, 2003

(51) Int. Cl.[7] ..... H01R 4/50
(52) U.S. Cl. ..... 439/347
(58) Field of Search ..... 439/347, 159, 439/160; 429/97

(56) References Cited

U.S. PATENT DOCUMENTS 5,065,004 A * 11/1991 Mizuno et al. ..... 235/479
5,099,512 A * 3/1992 Shigami et al. ..... 379/357.01
5,257,414 A 10/1993 Trahan
5,508,124 A * 4/1996 Gordecki et al. ..... 429/97
5,766,794 A * 6/1998 Brunette et al. ..... 429/97
5,790,659 A * 8/1998 Strand ..... 379/433.09
6,343,945 B1 2/2002 Liikanen
2003/0112592 A1 * 6/2003 Shin et al. ..... 361/683

FOREIGN PATENT DOCUMENTS

EP 1241798 9/2002

* cited by examiner

*Primary Examiner*—Phuong Dinh
(74) *Attorney, Agent, or Firm*—Winston Hsu

(57) ABSTRACT

An ejecting apparatus for ejecting a data card and releasing a first object from an electrical device. The ejecting apparatus includes a latch movably connected to the ejecting apparatus. The latch contains a retaining member adapted for insertion into a corresponding groove on the first object for engaging with the first object, and a releasing knob monolithically formed with the retaining member, and adapted to move the latch with respect to the ejecting apparatus for releasing the retaining member from the groove of the first object and enabling the first object to be removed from the electrical device. The ejecting apparatus also includes a pivoting shaft for pivotally connecting the ejecting apparatus to the electrical device, and at least one ejector leg for pushing the data card from the electrical device to eject the data card as the ejecting apparatus is rotated from the electrical device about the pivoting shaft.

10 Claims, 7 Drawing Sheets

LATCH FOR ELECTRICAL DEVICE COMBINED WITH DATA CARD EJECTOR

BACKGROUND OF INVENTION

1. Field of the Invention

The present invention relates to a data card holder of an electrical device, and more specifically, to a data card holder that can eject the data card and another object contained in the electronic device at the same time.

2. Description of the Prior Art

A data card of an electronic device is always fixed in a card holder. However, the data card should not be exposed to the outer environment in order to keep dust and other contaminants from damaging the data card. One solution was proposed by Liikanen in U.S. Pat. No. 6,343,945, which is herein incorporated by reference. U.S. Pat. No. 6,343,945 teaches a card holder that provides both retaining and releasing functions for a data card of an electronic device.

However, if a user wishes to eject both the data card and another object, such as a battery, from the electronic device, the user will have to eject each component separately. In this case, separate ejection mechanisms are used for ejecting the data card and the battery.

SUMMARY OF INVENTION

It is therefore a primary objective of the claimed invention to provide an ejecting apparatus of an electrical device that ejects a data card and a first object from the electrical device in order to solve the above-mentioned problems.

According to the claimed invention, an ejecting apparatus for an electrical device for ejecting a data card and releasing a first object from the electrical device is proposed. The ejecting apparatus includes a fastening latch movably connected to the ejecting apparatus. The fastening latch contains a retaining member adapted for insertion into a corresponding groove on the first object for engaging with the first object, and a releasing knob monolithically formed with the retaining member, and adapted to be activated to move the fastening latch in a first direction with respect to the ejecting apparatus for releasing the retaining member from the groove of the first object and enabling the first object to be removed from the electrical device. When the retaining member is engaged with the groove of the first object, a front edge of the retaining member is located at a first position, and when the retaining member is moved in the first direction to release the retaining member from the groove of the first object, the front edge of the retaining member is located at a second position. The ejecting apparatus also includes a pivoting shaft for pivotally connecting the ejecting apparatus to the electrical device, and at least one ejector leg for pushing the data card from the electrical device to eject the data card as the ejecting apparatus is rotated from the electrical device about the pivoting shaft.

It is an advantage of the claimed invention that the ejecting apparatus ejects both the data card and the first object. A user of the electrical device only has to press the releasing knob of the fastening latch to release the first object, and can eject the data card by simply rotating the ejecting apparatus outwards from the electrical device. Thus, only one ejecting device is needed to eject both the data card and the first object.

These and other objectives of the claimed invention will no doubt become obvious to those of ordinary skill in the art after reading the following detailed description of the preferred embodiment, which is illustrated in the various figures and drawings.

DETAILED DESCRIPTION

Figure 1:
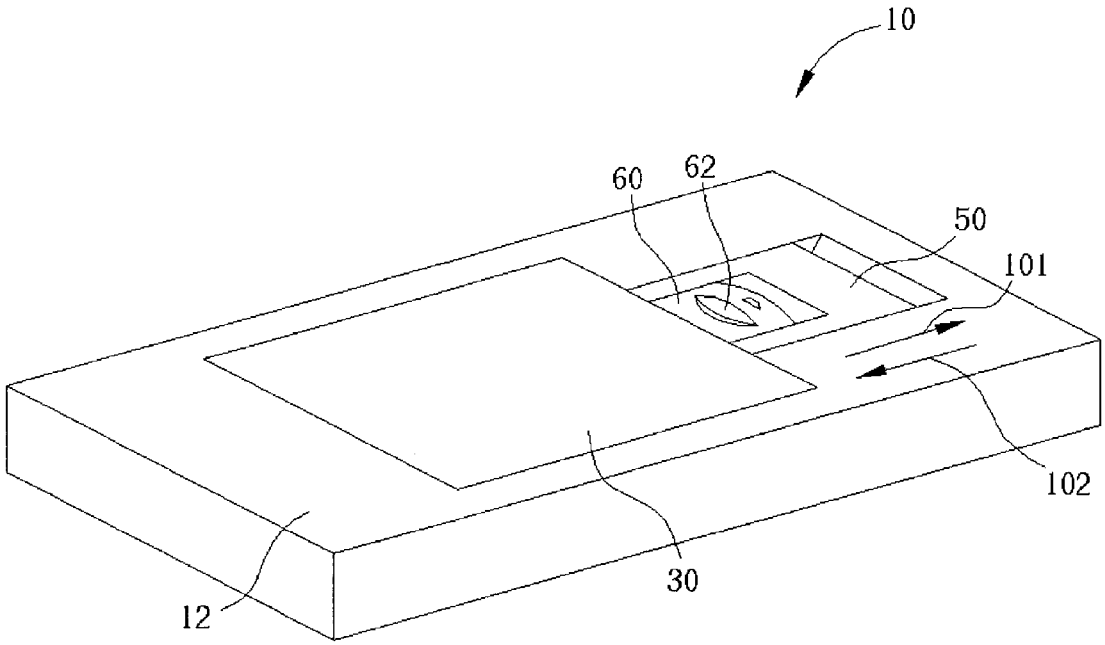
FIG. 1 is a perspective diagram of an electrical device containing an ejecting device according to the present invention.
Figure 2:
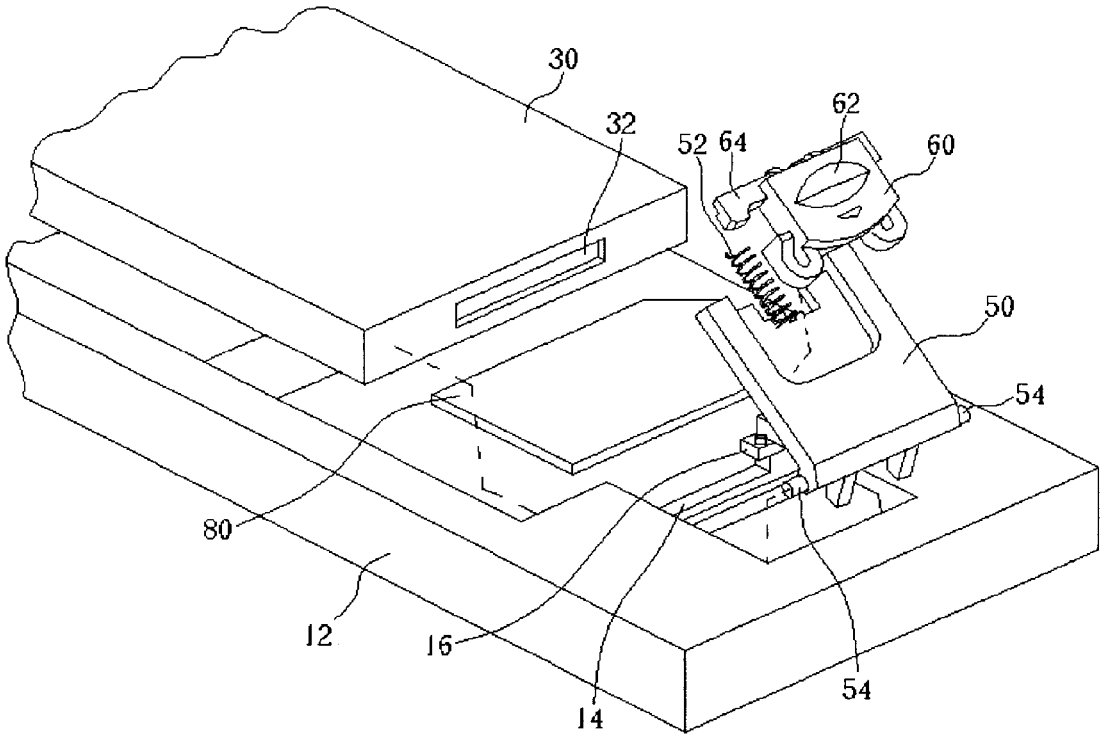
FIG. 2 is an exploded diagram of the electrical device.

Please refer to FIG. 1 and FIG. 2. FIG. 1 is a perspective diagram of an electrical device 10 containing an ejecting device 50 according to the present invention. FIG. 2 is an exploded diagram of the electrical device 10. The present invention ejecting device 50 is well-suited to portable electrical devices that contain a data card or memory chard, such as a mobile phone. The electrical device 10 contains a housing 12 for storing a data card 80 and a first object such as a battery 30. The data card 80 is used to provide data to the electrical device 10. The data card 80 can be a Subscriber Identity Module (SIM) card, a memory card such as a Compact Flash (CF) card, or another similar data card. During normal operation of the electrical device 10, the data card 80 is positioned beneath the ejecting device 50, and the battery 30 is held in place by the ejecting device 50. The present invention ejecting device 50 is utilized for releasing the battery 30 from the electrical device 10 and ejecting the data card 80, thereby using only the single, ejecting device 50 to eject two objects.

The ejecting device 50 contains a fastening latch 60 that moves in a first direction 101 or a second direction 102 (shown in FIG. 3) to release or retain the battery 30. The fastening latch 60 includes a releasing knob 62 which can be pushed or pulled by a user of the electrical device 10 to move the fastening latch 60 in the first direction 101. A retaining member 64, monolithically formed with the fastening latch 60, inserts into a groove 32 of the battery 30 to hold the battery 30 in place. When the fastening latch 60 is pushed in the first direction 101, the retaining member 64 moves out of the groove 32, allowing the battery 30 to be removed from the electrical device 10. When the user lets go of the fastening latch 60, a helical spring 52 will then push the fastening latch 60 back in the second direction 102.

The ejecting device 50 is pivotally connected to the housing 12 of the electrical device 10 with pivoting shafts 54. As will be explained in greater detail below, after the battery 30 is removed from the electrical device 10, the ejecting device 50 can be rotated away from the electrical device 10 about the pivoting shafts 54. To prevent the ejecting device 50 from rotating away from the electrical device 10 while the battery 30 remains inside the electrical device 10, two protruding members 16 hold the retaining member 64 of the fastening latch 60 against the housing 12 of the electrical device 10. After the battery 30 has been removed from the electrical device 10, the spring 52 moves the fastening latch 60 in the second direction 102 to allow the retaining member 64 to clear the protruding members 16. At this time, the ejecting device 50 can be rotated away from the electrical device 10 about the pivoting shafts 54.

Figure 3:
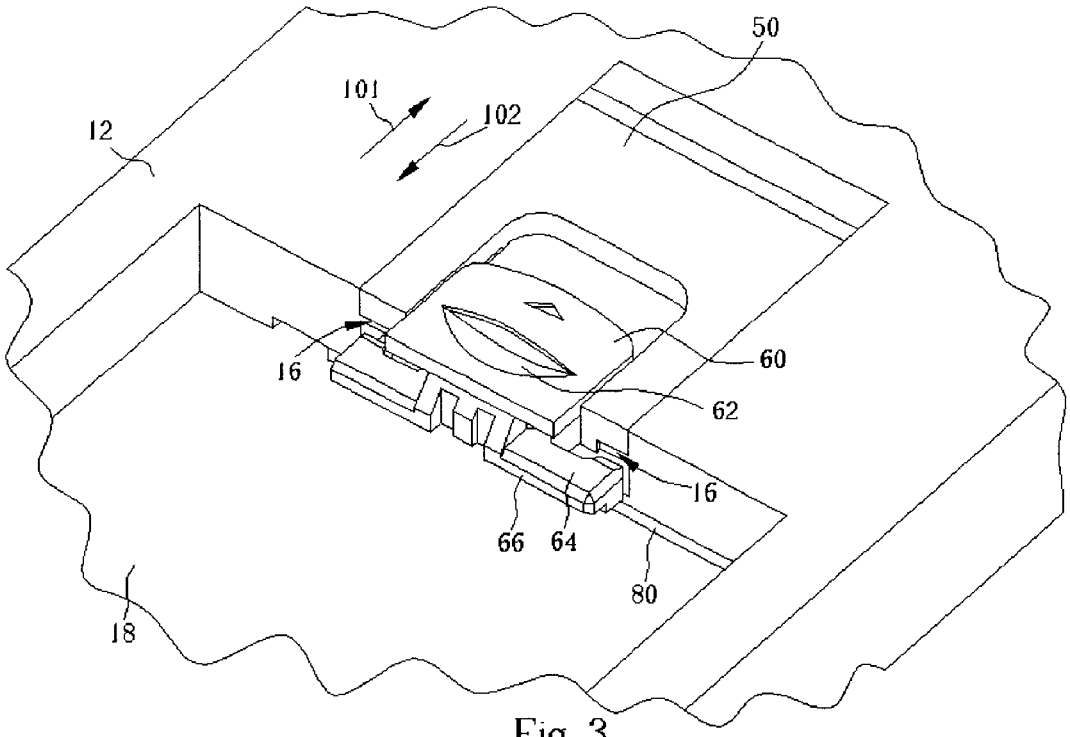
FIG. 3 shows position of a fastening latch after a battery has been removed from a cavity of the electrical device.

Please refer to FIG. 3. FIG. 3 shows position of the fastening latch 60 after the battery 30 has been removed from a, cavity 18 of the electrical device 10. In FIG. 1, the battery 30 was inserted into a cavity 18 of the housing 12 and held into place by the retaining member 64 of the fastening latch 60. FIG. 3 shows the retaining member 64 after being pushed in the second direction 102 by the spring 52. At this point, the retaining member 64 is no longer below the protruding members 16, and can be rotated away from the electrical device 10 about the pivoting shafts 54.

Figure 4:
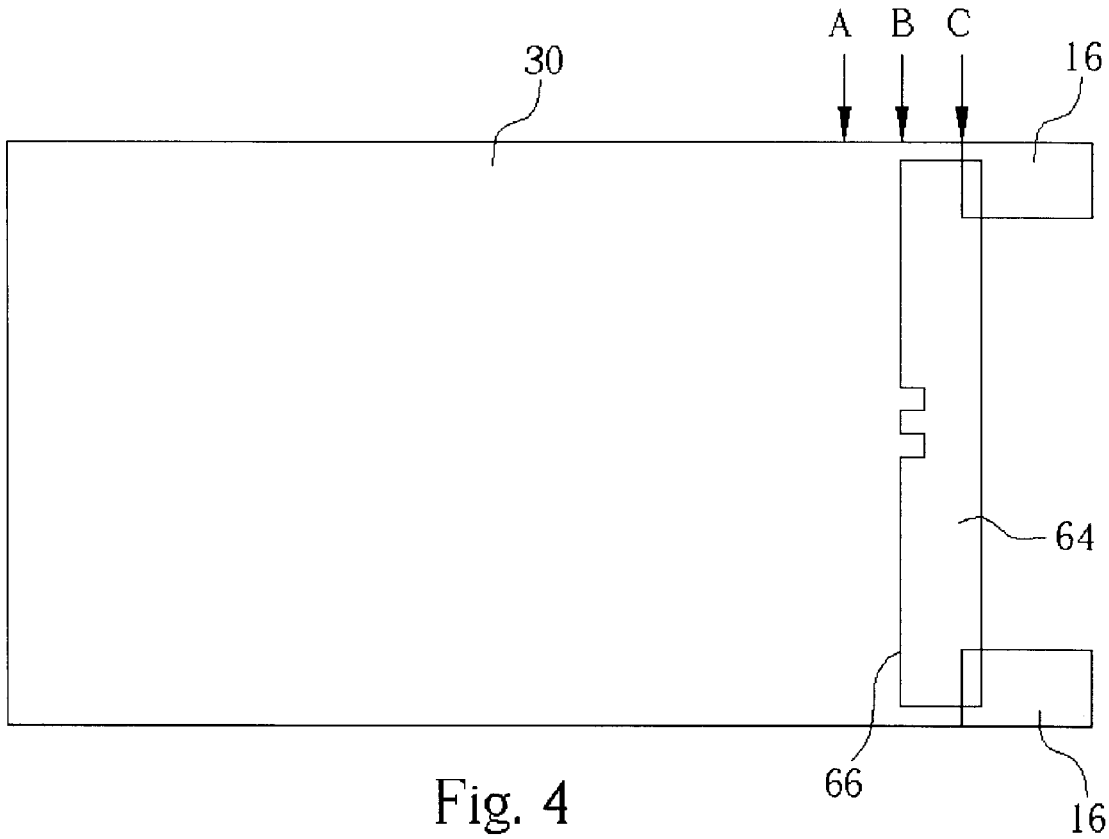
FIG. 4 through FIG. 6 show position of a retaining member relative to protruding members as the fastening latch is moved.
Figure 5:
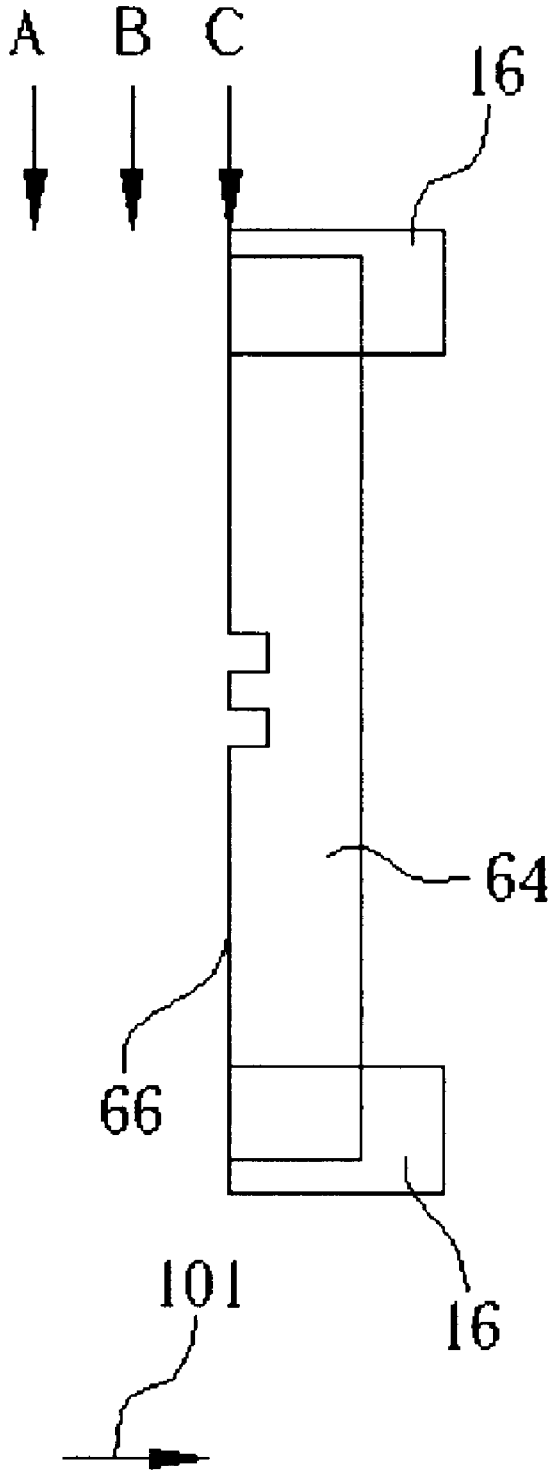
Figure 6:
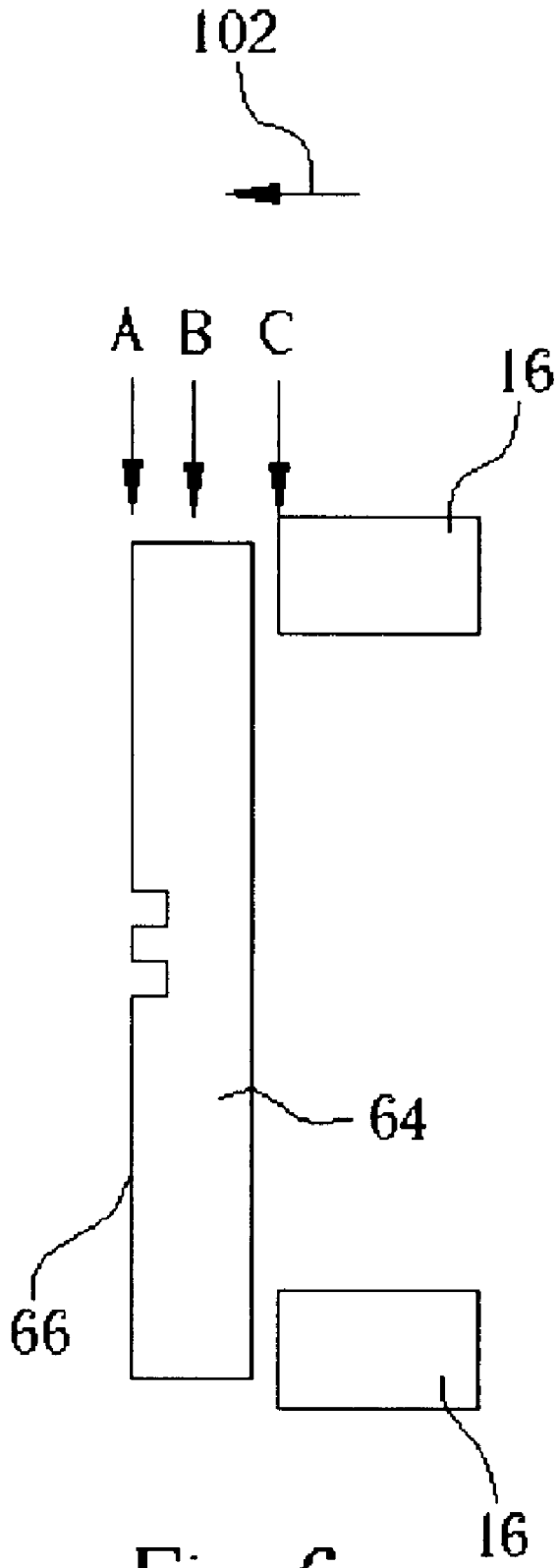

Please refer to FIG. 4 through FIG. 6. FIG. 4 through FIG. 6 show position of the retaining member 64 relative to the protruding members 16 as the fastening latch 60 is moved. In FIG. 4, the battery 30 is positioned in the cavity 18 of the housing 12, and a front edge 66 of the retaining member 64 is inserted in the groove 32 of the battery 30. At this time, the position of the front edge 66 of the retaining member 64 is marked by arrow B. A portion of the retaining member 64 is located beneath the protruding members 16 to prevent the ejecting device 50 from rotating about the pivoting shafts 54.

In FIG. 5, a user of the electrical device 10 has moved the fastening latch 60 in the first direction 101. Therefore, the front edge 66 of the retaining member 64 is now pointed to by arrow C. Since the retaining member 64 is no longer in the groove 32 of the battery 30, the battery 30 is removed from the cavity 18 of the housing 12. The retaining member 64 is still beneath the protruding members 16 at this time.

In FIG. 6, the releasing knob 62 of the fastening latch 60 is released, and the spring 52 pushes the fastening latch 60 in the second direction 102. The front edge 66 of the retaining member 64 is now pointed to by arrow A, and the retaining member 64 is no longer beneath the protruding members 16. Therefore, the ejecting device 50 can be: rotated away from the electrical device 10 about the pivoting shafts 54.

Figure 7:
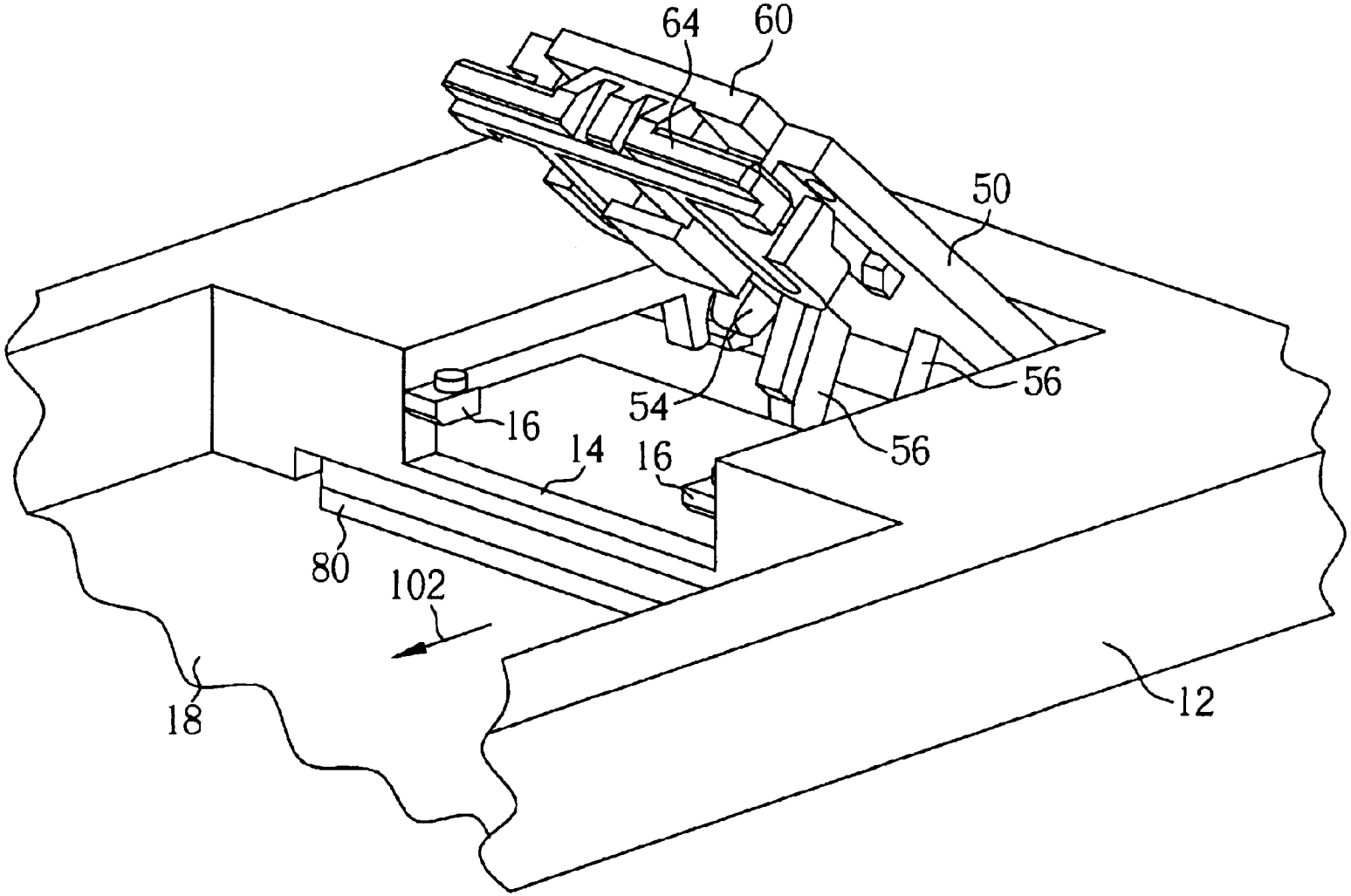
FIG. 7 shows the ejecting device being rotated away from the electrical device for ejecting a data card.

Please refer to FIG. 7. FIG. 7 shows the ejecting device 50 being rotated away from the electrical device 10 for ejecting the data card 80. A bottom surface of the ejecting device 50 contains legs 56 for pushing the data card 80 in the second direction 102 as the ejecting device 50 is rotated about the pivoting shafts 54. The housing 12 contains a constraining bar 14 for preventing the data card 80 from moving up and down with respect to the housing 12. As the ejecting device 50 rotates away from the electrical device 10 about the pivoting shafts 54, the legs 56 push the data card 80 in the second direction 102. The data card 80 moves under the constraining bar 14 into the cavity 18, which the battery 30 was just removed from. When the legs 56 push the data card 80 in the second direction 102, an electrical connection between the data card 80 and the electrical device 10 is terminated, stopping communication between the data card 80 and the electrical device 10.

In summary, the ejecting device 50 of the present invention can be used to eject both the battery 30 and the data card 80 from the electrical device 10. Please note that instead of the battery 30, the ejecting device 50 can also be used for holding and releasing other objects such as a battery cover. Unlike the prior art, the present invention uses the single ejecting device 50 to conveniently eject both the data card 80 and another object instead of using two separate ejecting devices.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An ejecting apparatus for an electrical device for ejecting a data card and releasing a first object from the electrical device, the ejecting apparatus comprising:

a fastening latch movably connected to the ejecting apparatus, the fastening latch comprising:

a retaining member adapted for insertion into a corresponding groove on the first object for engaging with the first object; and a releasing knob monolithically formed with the retaining member, and adapted to be activated to move the fastening latch in a first direction with respect to the ejecting apparatus for releasing the retaining member from the groove of the first object and enabling the first object to be removed from the electrical device, wherein when the retaining member is engaged with the groove of the first object, a front edge of the retaining member is located at a first position, and when the retaining member is moved in the first direction to release the retaining member from the groove of the first object, the front edge of the retaining member is located at a second position;

a pivoting shaft for pivotally connecting the ejecting apparatus to the electrical device; and at least one ejector leg for pushing the data card from the electrical device to eject the data card as the ejecting apparatus is rotated from the electrical device about the pivoting shaft.

2. The ejecting apparatus of claim 1 wherein the electrical device comprises at least one protruding member for restricting rotation of the ejector from the electrical device about the pivoting shaft when the front edge of the retaining member is in the first or second positions.

3. The ejecting apparatus of claim 2 wherein after the first object has been removed from the electrical device, the front edge of the retaining member is capable of moving to a third position, wherein when the front edge of the retaining member is at the third position, the protruding member does not restrict rotation of the ejector from the electrical device about the pivoting shaft.

4. The ejecting apparatus of claim 2 further comprising an elastic device for pushing the retaining member in a second direction, the second direction being opposite to the first direction.

5. The ejecting apparatus of claim 4 wherein after the first object has been removed from the electrical device, the elastic device pushes the front edge of the retaining member to a third position, wherein when the front edge of the retaining member is at the third position, the protruding member does not restrict rotation of the ejector from the electrical device about the pivoting shaft.

6. The ejecting apparatus of claim 4 wherein the elastic device is a helical spring.

7. The ejecting apparatus of claim 1 wherein the fastening latch and the pivoting shaft are formed on opposite ends of the ejecting apparatus.

8. The ejecting apparatus of claim 1 wherein as the ejector is rotated from the electrical device about the pivoting shaft, the ejector leg pushes the data card in a second direction to eject the data card, the second direction being opposite to the first direction.

9. The ejecting apparatus of claim 1 wherein the first object is a battery used to provide power to the electrical device.

10. The ejecting apparatus of claim 1 wherein the first object is a battery cover of the electrical device.

* * * * *

UNITED STATES PATENT AND TRADEMARK OFFICE

CERTIFICATE OF CORRECTION

PATENT NO. : 6,875,041 B1
APPLICATION NO. : 10/605194
DATED : April 5, 2005
INVENTOR(S) : Chang et al.

It is certified that error appears in the above-identified patent and that said Letters Patent is hereby corrected as shown below:

On the Title Page, item (75)

Please change "Leo Lai" to --Jen-Cheng Lai--

Signed and Sealed this

Twentieth Day of May, 2008

JON W. DUDAS
*Director of the United States Patent and Trademark Office*